US011624509B2

(12) United States Patent
Hawkinson et al.

(10) Patent No.: US 11,624,509 B2
(45) Date of Patent: Apr. 11, 2023

(54) GUARD AND COVER FOR OUTDOOR FIRE HEATING APPLIANCES

(71) Applicant: The Outdoor Greatroom Company, LLC, Burnsville, MN (US)

(72) Inventors: Eric Hawkinson, Prior Lake, MN (US); Luke Sudman, Burnsville, MN (US)

(73) Assignee: The Outdoor Greatroom Company, LLC, Burnsville, MN (US)

( * ) Notice: Subject to any disclaimer, the term of this patent is extended or adjusted under 35 U.S.C. 154(b) by 277 days.

(21) Appl. No.: 16/716,837

(22) Filed: Dec. 17, 2019

(65) Prior Publication Data

US 2020/0248910 A1 Aug. 6, 2020

Related U.S. Application Data

(60) Provisional application No. 62/781,953, filed on Dec. 19, 2018.

(51) Int. Cl.

| | |
|---|---|
| ***F24C 15/36*** | (2006.01) |
| ***A47B 85/06*** | (2006.01) |
| ***A47B 13/08*** | (2006.01) |

(52) U.S. Cl.

CPC ..... *F24C 15/36* (2013.01); *A47B 13/08* (2013.01); *A47B 85/06* (2013.01)

(58) Field of Classification Search

CPC ..... F24C 15/36; F24C 15/12; A47B 13/08; A47B 85/06; A47B 37/04; F24B 1/192

USPC ..... 126/544; 108/27, 61, 60; 312/140, 312/140.4, 137

See application file for complete search history.

(56) References Cited

U.S. PATENT DOCUMENTS

| | | | | | |
|---|---|---|---|---|---|
| 1,440,336 | A | * | 12/1922 | Buffington | F24C 15/36 126/201 |
| 3,059,632 | A | * | 10/1962 | Rogers | F24C 15/12 126/37 R |
| 3,229,679 | A | * | 1/1966 | Boij | F24C 5/20 126/38 |
| 3,632,180 | A | * | 1/1972 | Hauville | B01L 9/02 104/246 |
| 3,713,432 | A | * | 1/1973 | Finley | F24C 15/28 126/38 |
| 4,157,705 | A | * | 6/1979 | Caan | F24C 15/36 126/211 |
| 5,004,303 | A | * | 4/1991 | Conway | A47F 3/004 312/140 |

(Continued)

FOREIGN PATENT DOCUMENTS

| | | | |
|---|---|---|---|
| CN | 200993413 | * | 12/2007 |
| CN | 201069191 | * | 6/2008 |

(Continued)

*Primary Examiner* — Janet M Wilkens

(74) *Attorney, Agent, or Firm* — Schwegman Lundberg & Woessner, P.A.

(57) ABSTRACT

A convertible guard device for a fire heating appliance. The guard device having a plurality of panels and a base portion, wherein the panels may be configured to be arranged in a guard configuration and a tabletop configuration. The base portion may define a fire area and have an upper surface configured to receive the panels arranged in the guard configuration, and an inner surface having a ledge extending therefrom, the ledge configured to receive a perimeter edge of the panels when the panels are arranged in the tabletop configuration.

26 Claims, 17 Drawing Sheets

(56) References Cited

U.S. PATENT DOCUMENTS

| | | | | | |
|---|---|---|---|---|---|
| 5,785,046 | A * | 7/1998 | Colla | F24B 1/202 | 126/9 R |
| 6,371,105 | B1 * | 4/2002 | Merritt | F24C 15/12 | 126/211 |
| 6,398,322 | B1 * | 6/2002 | Chaplin | A47F 3/005 | 312/114 |
| 6,647,899 | B1 * | 11/2003 | Lysien | A47B 13/00 | 108/24 |
| 2009/0205639 | A1 * | 8/2009 | Ip | F24C 3/085 | 126/9 R |
| 2013/0186003 | A1 * | 7/2013 | Anderson | G01M 11/04 | 49/367 |
| 2018/0078056 | A1 * | 3/2018 | Adair | A63H 33/107 | |
| 2019/0346151 | A1 * | 11/2019 | Bell | B60N 3/16 | |

FOREIGN PATENT DOCUMENTS

| | | | |
|---|---|---|---|
| CN | 209336577 | * | 9/2019 |
| DE | 10217048 | * | 11/2003 |
| EP | 2950003 | * | 12/2015 |
| GB | 2263545 | * | 7/1993 |
| KR | 20160112427 | * | 9/2016 |

* cited by examiner 900
906
908
908
906
906
906

GUARD AND COVER FOR OUTDOOR FIRE HEATING APPLIANCES

PRIORITY APPLICATIONS

This application claims the benefit of priority to U.S. Provisional Application Ser. No. 62/781,953, filed Dec. 19, 2018, the content of which is incorporated herein by reference in its entirety.

FIELD OF THE INVENTION

The present application relates generally to systems for open flame heating and/or ambiance such as for outdoors, spacious areas, vented areas and the like. More particularly, the present application relates to accessories for a fire table, fire pit, or other outdoor fire heating appliance. Still more particularly, the present application relates to a convertible guard device for surrounding a flame or other heat producing device of a heating appliance, wherein the guard device is convertible into a table top cover for the heat producing device.

DETAILED DESCRIPTION

The present application, in some embodiments, relates to a guard device for a fire table, fire pit, or other outdoor fire heating appliance having an open flame. The guard device may generally provide both a cover for the fire heating appliance, i.e. when the appliance is not in use, and may additionally provide a guard to shield the open flame when the fire heating appliance is in use. The guard device may be configured to be arranged in a first configuration, which may be an upright configuration, with the panels upright and surrounding a flame or fire area of the fire heating appliance. In the upright configuration, the guard device may generally guard the flame from wind, dust, children or other users, and/or other elements. Additionally, the guard device may be configured to be arranged in a second configuration, which may be a tabletop configuration, with the panels laying down over the fire area of the fire heating appliance. In the tabletop configuration, the guard device may generally protect the fire area from rain, debris, and/or other elements when not in use. The tabletop configuration may also increase the useable area of the table and provide a surface on which users may place articles, as a tabletop. A guard device of the present disclosure may provide an improvement over conventional flame guards and conventional fire heating appliance covers. For example, a guard device of the present disclosure may provide the benefits of both a flame guard and a cover without the need to store components when not in use, as the guard device may easily convert between the two functions.

Figure 1:
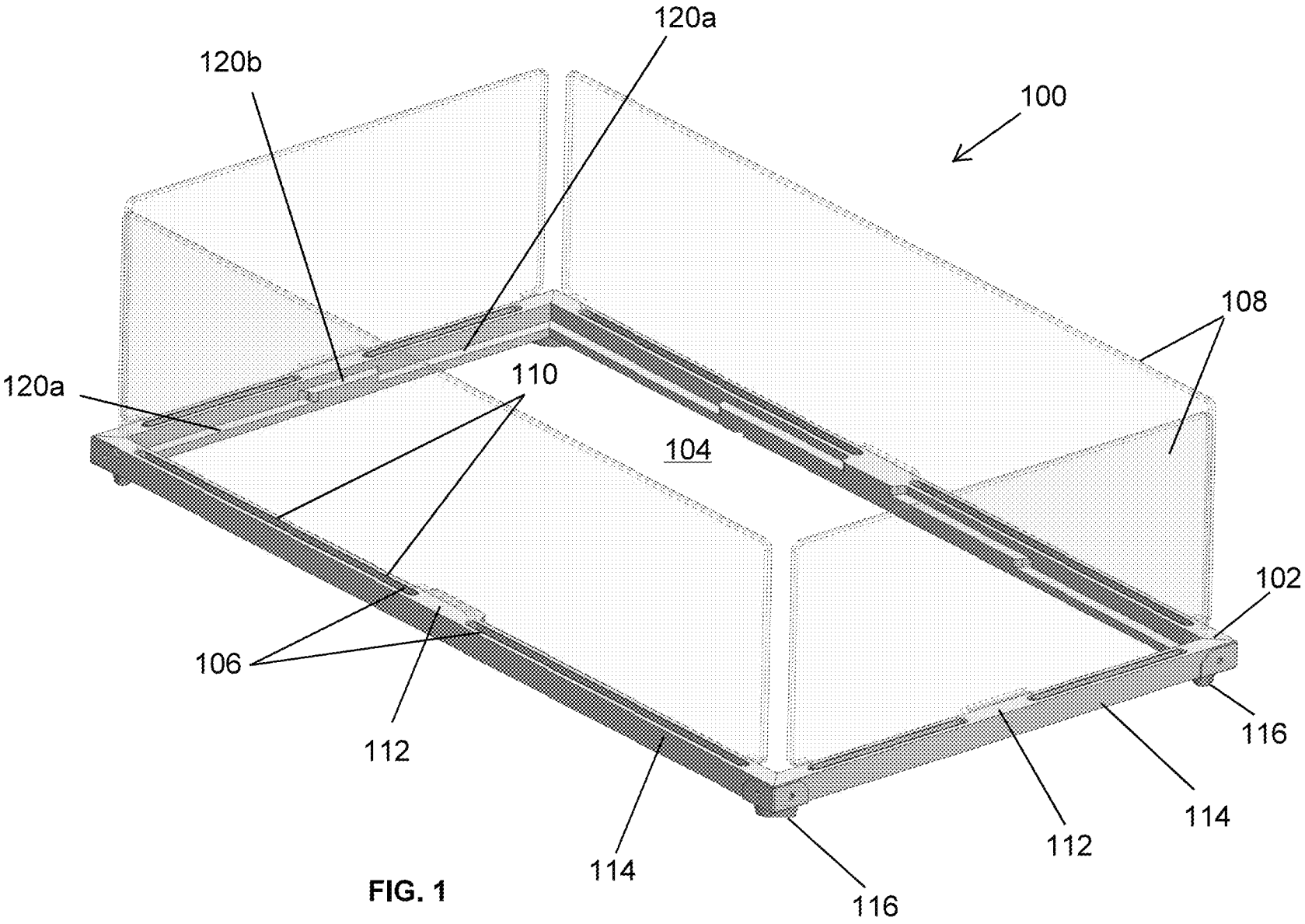
FIG. 1 is a perspective view of a guard device of the present disclosure, with panels in an upright configuration, according to one or more embodiments.

Turning now to FIG. 1, a guard device 100 of the present disclosure is shown, according to at least one embodiment. The guard device 100 may be configured to be arranged on or over a fire pit or fire table, for example. In at least one embodiment, the guard device 100 may be configured to be used with a fire table similar to those described in U.S. Provisional Application No. 62/616,054, entitled Outdoor Heating Appliance with Ground Level Heat, and filed Jan. 11, 2018, the content of which is hereby incorporated by reference herein in its entirety. The guard device 100 may generally have a base portion 102 defining or surrounding a fire area 104. The base portion 102 may have one or more grooves 106 configured to receive one or more panels 108.

Figure 2:
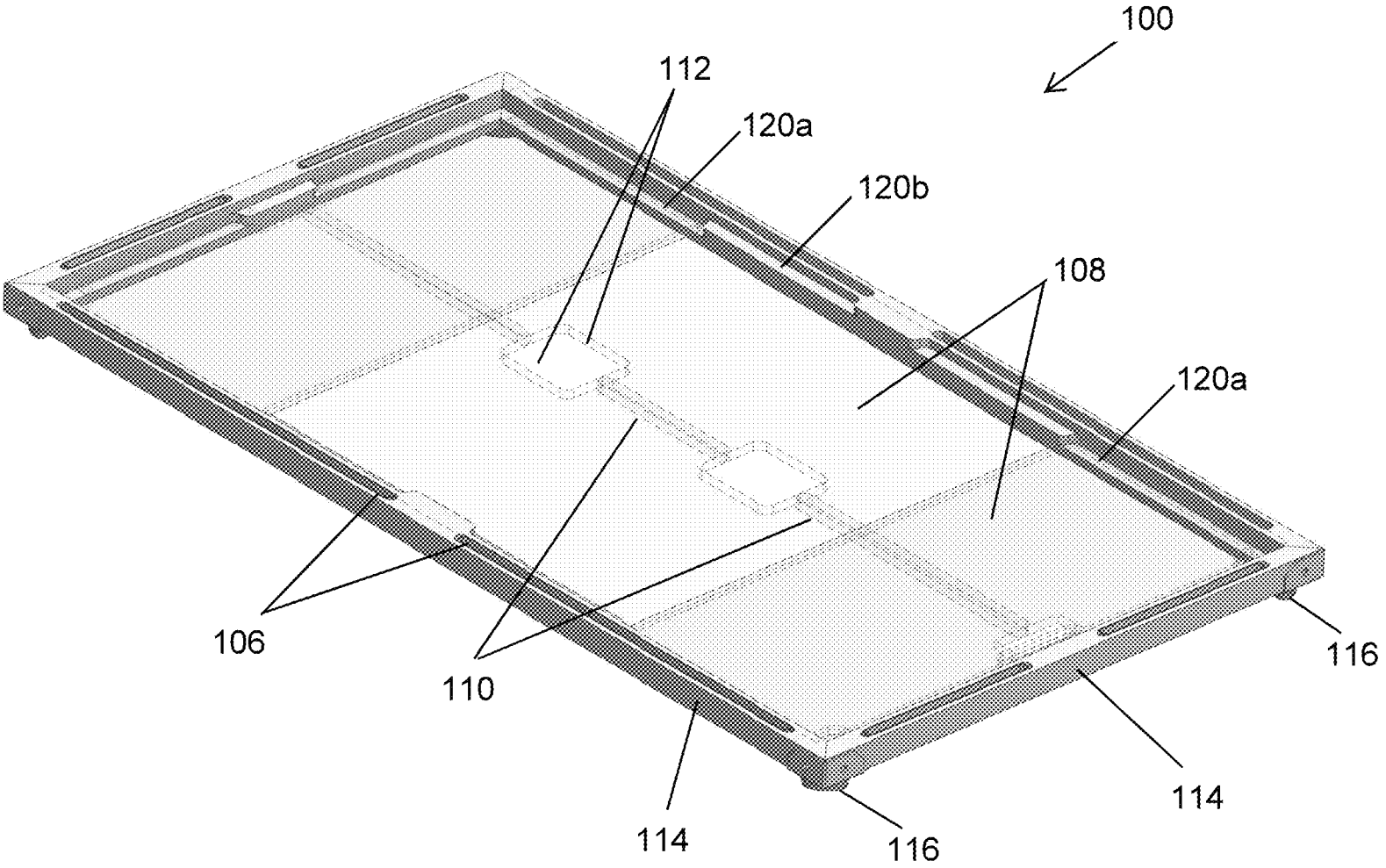
FIG. 2 is another perspective view of the guard device of FIG. 1, with panels in a tabletop configuration, according to one or more embodiments.

The one or more panels 108 may be removable from the base 102, and may be configured to be arranged in two configurations. In a first configuration (or an upright configuration), as shown in FIG. 1, the panels 108 may be generally arranged upright on the base portion 102, and may be configured to surround the fire area 104, such as on a fire table or fire pit, to shield a flame from wind and other elements. Additionally, in a second configuration (or a tabletop configuration), as shown in FIG. 2, the panels 108 may be generally arranged in a laying down or flattened position in the fire area 104, and may be configured to cover a flame generating device or burner device when not in use.

In some embodiments, each panel 108 may have a generally flattened shape. In some embodiments, each panel 108 may have a rectangular shape with a length and width. In other embodiments, one or more panels 108 may have a square shape, triangular shape, half circle shape, or any other suitable shape. The panels 108 may have a width that, when the panels are arranged in the upright configuration, extends upward from the base portion 102. The width of the panels 108 may be configured to provide wind and/or access protection for a flame arranged within the fire area 104 when the panels are arranged in the upright configuration. In some embodiments, the panels 108 may have a same width, such that they may uniformly extend a same width from the base portion 102. Each panel 108 may have a length perpendicular to the width which, when in the upright configuration, extends along a side of the base 102. The lengths of the panels 108 may depend on the size and/or shape of the base portion 102 and/or fire area 104. In general, the lengths of the panels 108 may be configured such that the panels may substantially form a perimeter around the fire area 104. In this way, each panel 108 may have a length similar to a side length of the base portion 102 and/or a side length of the fire area 104. The panels 108 may have different lengths. As shown in FIG. 1, for example, where the base portion 102 is rectangular and defines a rectangular-shaped fire area 104, two panels 108 may have a longer length configured for arranging on the longer sides of the base portion, and two panels may have a shorter length configured for arranging on the shorter sides of the base portion. Additionally, the panels 108 may have any suitable depth. In general, the depth of the panels 108 may be sufficient to add stability during handling of the panels, such as while a user transitions the panels between the upright configuration and the tabletop configuration. The panels 108 may be constructed of glass in some embodiments. In some embodiments, the glass may be clear or relatively translucent such that a flame within the fire area 104 may be viewable through the panels 108. In other embodiment, the panels 108 may be constructed of clear or relatively translucent plastic, Plexiglas, heat resistant materials, and/or other materials.

In some embodiments, each panel 108 may have one or more flanges or tabs 110 configured for engaging with grooves 106 or slots in the base portion 102 to position the panels in the upright configuration. For each panel 108, the one or more flanges 110 may extend from a side of the panel, such as a lengthwise side of the panel. Each flange 110 may have a width extending outward from the panel and configured to extend into the base portion 102. Additionally, each flange 110 may have any suitable length along a portion of the length of the panel 108. In some embodiments, the number of flanges 110 on a panel 108 may depend on the length of the panel. For example, as shown in FIG. 1, longer panels 108 may have three flanges 110, while shorter panels may have two flanges. Other panels 108 may have one, four, five, or any other suitable number of flanges 110.

Additionally, each panel 108 may have one or more gaps 112 or openings. The gaps 112 may be configured to provide hand holds for handling the panels 108. The gaps 112 may generally be arranged along a same side of each panel 108 as the flanges 110. In some embodiments, the gaps 112 may be arranged generally between the flanges 110. For example, the gaps 112 may be defined by the spacing between flanges 110. That is, where two flanges 110 extend along a length of a panel 108, the flanges may be separated by distance between them. The distance between the two flanges 110 may provide a gap 112 for a handhold. In other embodiments, however, the gaps 112 may be openings or recesses extending into the width of the panels 108. When the panels 108 are arranged in the upright configuration, the gaps 112 may generally allow a user to pull up on the panels to remove the flanges 110 from the base portion 102. When the panels 108 are arranged in the tabletop configuration, the gaps 112 may generally allow a user to grasp the panels to lift them out of the tabletop configuration. Additionally, in some embodiments, the gaps 112 may be configured to allow air to flow through to an active flame in the fire area 104 when the panels 108 are arranged in the upright configuration. That is, the gaps 112 may provide airflow through the perimeter guard for combustion of the fuel providing the flame.

As indicated above, the panels 108 may be configured to be arranged in an upright configuration and in a tabletop configuration. An upright configuration is shown in FIG. 1. In this configuration, the panels 108 may generally be configured to form a barrier or partial barrier around the fire area 104. In this way, the panels 108 may act to shield an active flame in the fire area 104 against wind and/or other elements. In some embodiments, the panels 108 may additionally act as a safety barrier in the upright configuration, preventing children or other users from reaching into the active flame. A tabletop configuration is shown in FIG. 2. The tabletop configuration may be used when the fire area 104 is not in use (i.e., when there is no active flame). The panels 108 may operate to cover the inactive fire area 104 to protect the fire area from rain, debris, and/or other elements. For example, where the fire area 104 comprises a burner having a plenum and a plurality of orifices, as described for example in U.S. Provisional Application No. 62/616,096, entitled Burner for Outdoor Fire Heating Appliances, and filed Jan. 11, 2018, the content of which is hereby incorporated herein by reference in its entirety, the panels 108 may prevent rain, debris, and/or other elements from entering the orifices. Additionally, in the tabletop configuration, the panels 108 may provide a table surface across the fire area 104. That is, the panels 108 may operate to convert the fire area 104 to a useable table surface on which users may place articles such as drinks, plates, and other items.

The base portion 102 may be configured to support the panels 108 in the upright and tabletop configurations. Additionally, the base portion 102 may be configured to arrange the guard device 100 on or over a fire pit, fire table, or other fire heating or flame producing appliance. The base 102 may generally be shaped to surround a fire area of a fire table, fire pit, or other flame producing appliance. For example, where a fire area has a rectangular shape, the base 102 may have a similar rectangular shape. In other embodiments, the base 102 may have a square, triangular, or other suitable shape. The base 102 may be constructed of one or more metals or other fire resistant materials. The base 102 may have a number of sides or members 114. For example, where the base 102 has a rectangular shape, the base may have two long sides and two short sides. Each side may be a member 114, such that the four members may be coupled together to at their respective ends to form the base. In some embodiments, each side or member 114 may be configured to receive a panel 108 in an upright configuration. In other embodiments, each side or member 114 may be configured to receive a plurality of panels 108. In some embodiments, the base 102 may have one or more feet 116 for arranging the base on a fire table, fire pit, or other flame producing appliance. The one or more feet 116 may be, for example, rubber feet, configured to position the base 102 on a fire table, for example, without damaging the fire table surface. The feet 116 may additionally help to hold the base 102 in place on the fire table surface or other surface by providing friction. In some embodiments, the base 102 may have four feet 116, such as one at each corner of a rectangular or square shaped base.

In some embodiments, the base 102 may additionally have one or more grooves 106 or recesses for receiving the panels 108 in an upright configuration. For example, where the base 102 is constructed of four members 114, each member may have one or more grooves 106 for receiving a panel 108. The one or more grooves 106 on each member 114 may be arranged on an upper surface of the member. The groove(s) 106 may be configured to receive a flange 110 of a panel 108, such that the panel may extend upward from the base 102. The grooves 106 arranged in a member 114 may correspond in number, size, and shape with the flanges 110 on a panel 108 to be arranged over that member. That is, for example, where a panel 108 has three flanges 110, a corresponding member 114 may have three grooves 106 to receive the flanges. The grooves 106 may each have a length corresponding with the length(s) of the three flanges 110 on the panel 108. The grooves 106 may have a width corresponding with a thickness of the panel 108. In some embodiments, the grooves 106 may have a width slightly wider than the thickness of the panel 108 for ease of placement. The grooves 106 may each have a depth extending a distance into the interior of the base 102. The depth may correspond with the size of the flanges 110 of a panel 108. In some embodiments, the grooves 106 may have a depth extending through the full depth of the base 102, such that the grooves may be open on both upper and lower surfaces.

In some embodiments, a groove 106 may have one or more lights, such as LED lights, arranged within the groove. As shown for example in FIG. 5, one or more LED lights 118 or other lights may be arranged on an inner surface of one or more grooves 106. The LED lights 118 or other lights may be configured to illuminate a panel 108 by shining on a panel flange 110 arranged in the groove 106. The LED lights 118 or other lights may be battery powered or solar powered in some embodiments. In other embodiments, the base portion 102 may have wiring configured to connect the LED lights 118 to an external power source.

Figure 3:
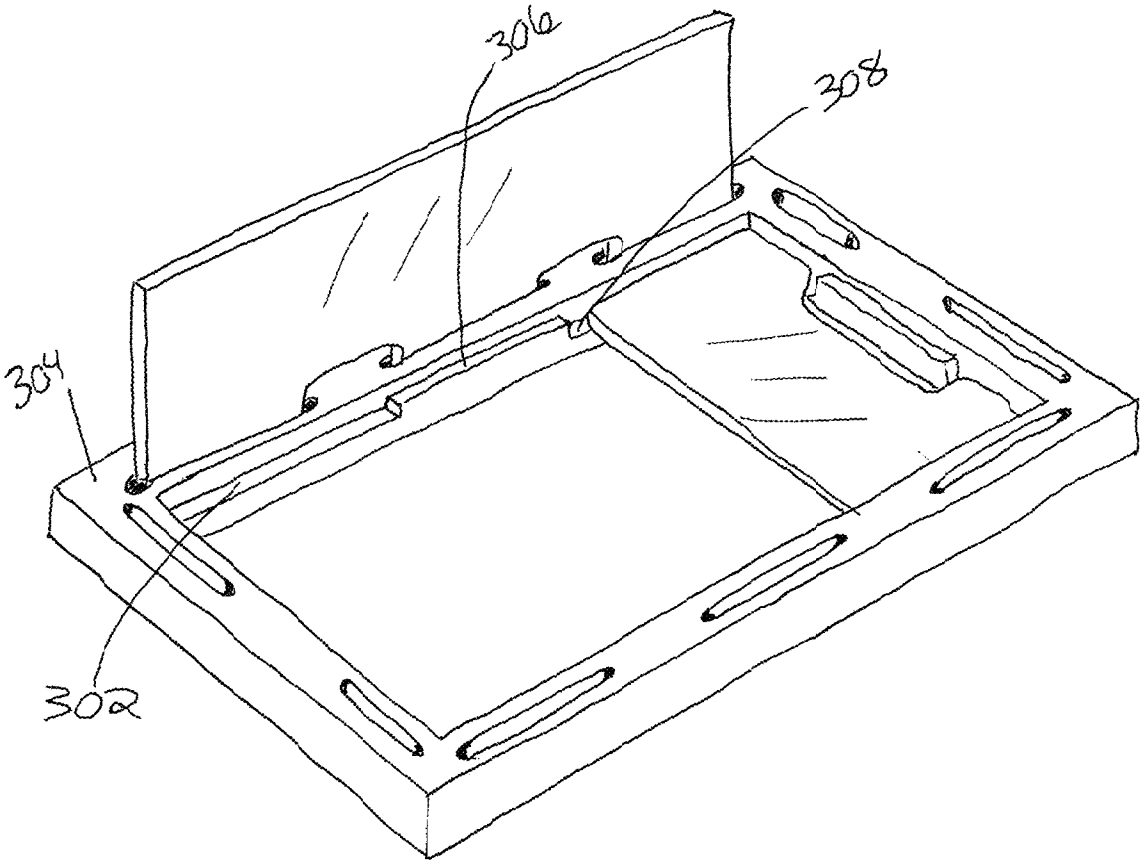
FIG. 3 is a perspective view of a guard device of the present disclosure, with one panel of the guard device in a tabletop configuration, and one panel in an upright configuration, according to one or more embodiments.

In addition to the grooves 106, the base 102 may have one or more ledges 120 for supporting the panels 108 in a tabletop configuration. The one or more ledges 120 may be arranged on an inner surface of the base 102, such as on an inner surface of each member 114 or side of the base. The one or more ledges 120 may be configured to support the edges of the panels 108 as the panels are laid between the sides or members 114 of the base 102. As shown, for example, in FIGS. 2 and 3, the panels 108 may be configured to be arranged in a flattened, and in some embodiments, stacked, configuration over the base 102 or between the members 114 of the base. As shown in FIG. 3, each side or member 114 of the base 102 may have one or more lower ledge portions 120*a* and one or more upper ledge portions 120*b*. The upper 120*b* and lower ledges 120*a* may generally extend inward from the side or member 114 of the base 102, toward a center of the base. The ledges 120 may each have any suitable width extending inward from the member 114 or side, configured to support the panels 108 by supporting them at the edges of the panels.

Upper ledge portions 120*b* may be configured to position one or more panels 108 above panels arranged on lower ledge portions 120*a*. In this way, panels 108 may be stacked on the ledge portions 120, with one or more panels arranged on lower ledge portions 120*a*, and one or more panels arranged above on upper ledge portions 120*b*. In some embodiments, the ledge portions 120 may be arranged at heights along an inner surface of the base member 114 or side so as to position the one or more panels 108 to be flush or nearly flush with an upper surface of the base portion 102. That is, for example, the upper ledge portions 120*b* may be arranged at a position along a height of the inner surface of the base portion 102, such that the depth of a panel 108 may extend between each upper ledge portion and the upper surface of the base portion. In this way, when panels 108 are arranged on the upper ledge portions 120*b*, the panels may create a table surface flush or nearly flush with the upper surface of the base portion 102. Lower ledge portions 120*a* may be arranged along a height of the inner surface of the base portion 102, such that the depth of a panel 108 may be arranged beneath a panel arranged on the upper ledge portions 120*b*.

Figure 4:
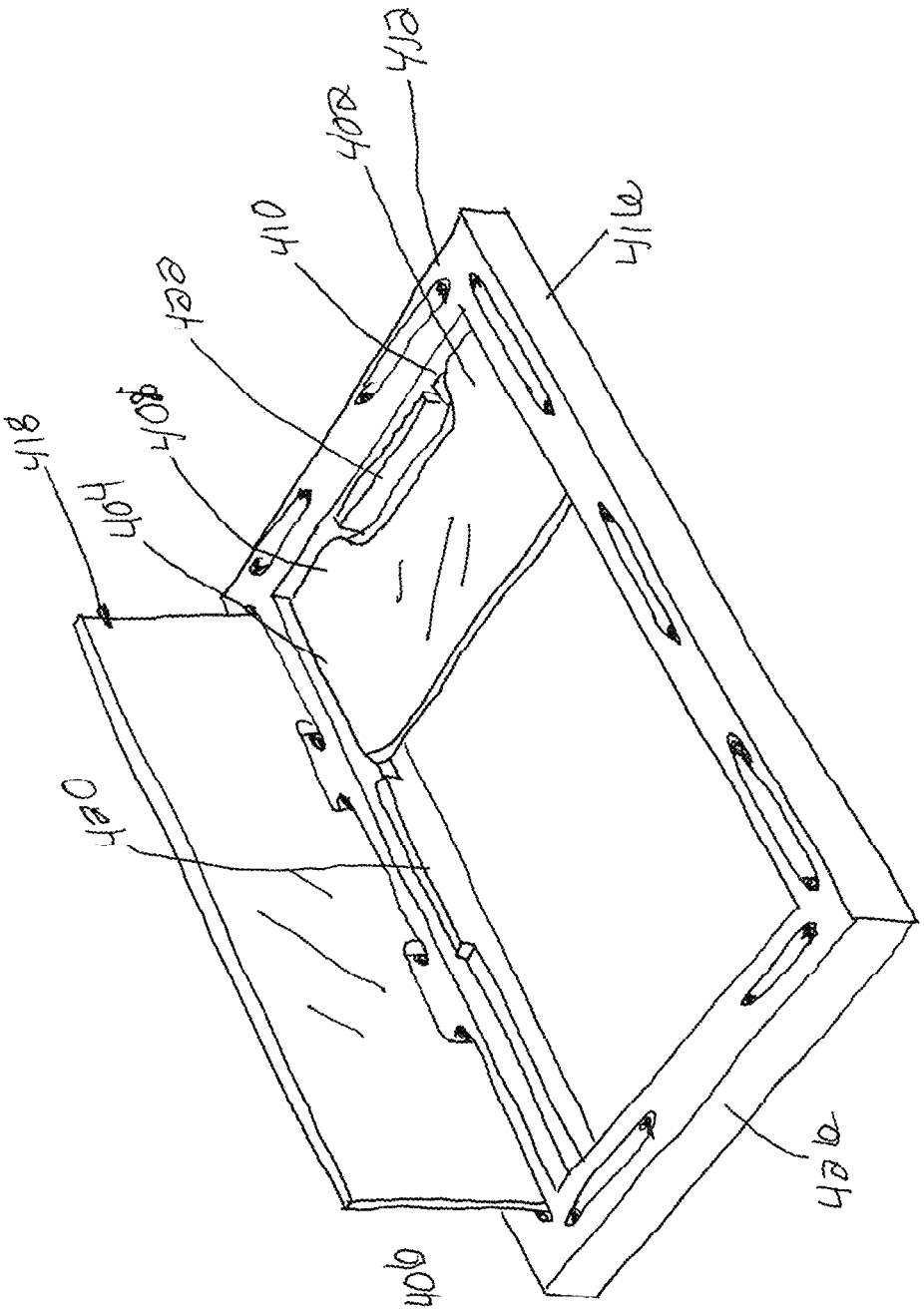
FIG. 4 is a perspective view of another guard device of the present disclosure, with one panel of the guard device in a tabletop configuration, and one panel in an upright configuration, according to one or more embodiments.

In some embodiments, each ledge portion 120 of a member 114 or side may be configured to support a different panel 108. For example, and with reference to FIG. 3, a first lower ledge portion 302 on a member 304 may be configured to provide support for a first panel. An upper ledge portion 306 on the same member 304 may be configured to provide support for a second panel, and a second lower ledge portion 308 on the same member 304 may be configured to provide support for a third panel. In some embodiments, a ledge portion may be configured to provide support for more than one panel. In this way, each panel may be supported at its perimeter by multiple ledge portions extending from different members or sides of the base. In some embodiments, the ledges may be configured such that each panel is supported by three sides or members of the base portion. For example, as shown in FIG. 4, a first panel 402 may be supported by a first lower ledge 404 of a first member 106, a first 108 and second 410 lower ledge of a second member 412, and a first lower ledge (not shown) of a third member 416. A second panel 418, configured to be stacked or arranged over the first panel 402, may be supported by an upper ledge portion 420 of the first member 406, an upper ledge portion 422 of the second member 412, and an upper ledge (not shown) of a fourth member 426. A portion of the second panel 418 may overlap or cover a portion of the first panel.

While FIGS. 1-4 are described above with respect to a guard device configured to be arranged or on a fire table, fire pit, or other flame producing appliance, it is to be appreciated that in some embodiments, a guard device may be integrated with a flame producing appliance. For example, a table portion of a fire table may have a recessed portion configured to receive the base portion of a guard device of the present disclosure. In such embodiments, the panels of the guard device may be configured to be arranged on or over an upper surface of the base portion when the panels are arranged in the tabletop configuration. That is, where the base portion may be recessed in or below a table portion of a fire table, the panels may be laid over an upper surface of the base portion itself, rather than being arranged over ledges within the base portion. In other embodiments, the base portion of a guard device may be, or may be an integral part of, a table portion of a fire table or other flame producing appliance. In still other embodiments, the base portion of a guard device may be removably or fixedly attached to a table portion of a fire table, or otherwise to a flame producing appliance.

In use, the guard device may provide removable panels that may be arranged in an upright configuration to shield an active flame in a fire area, or alternatively in a tabletop configuration to cover the fire area when not in use. Additionally, the panels may be configured to provide a surface that may be used as a table surface, when in the tabletop configuration. The panels may be easily converted from one configuration to the other. A user may simply lift the panels and arrange them either upright, by inserting flanges of the panels into the grooves on the base portion, or laying down in the tabletop configuration by arranging the panels across the fire area and on the inner surface ledges of the base portion. The panels may generally provide a protective cover for the fire area when the fire area is not in use. In this way, the panels may eliminate the need for cloth covers or fire table or fire pit covers. When ready to use the fire area, a user may remove the panels from the fire area and arrange them in an upright configuration around the fire area. In this way, the need to store a fire area cover may be eliminated as well. That is, cloth covers or other fire area covers usually need to be stored or placed out of the way while the fire area is in use. The guard of the present disclosure may provide a fire area cover that does not need to be stored or otherwise placed out of the way while the fire area is in use. Instead, the panels forming the fire area cover may be converted into a fire area guard. A guard device of the present disclosure generally allows a user to have both a fire area guard and a fire area cover in a single device, without having to store either component when not in use, and without having to worry about compatibility between guards and covers.

Figure 7:
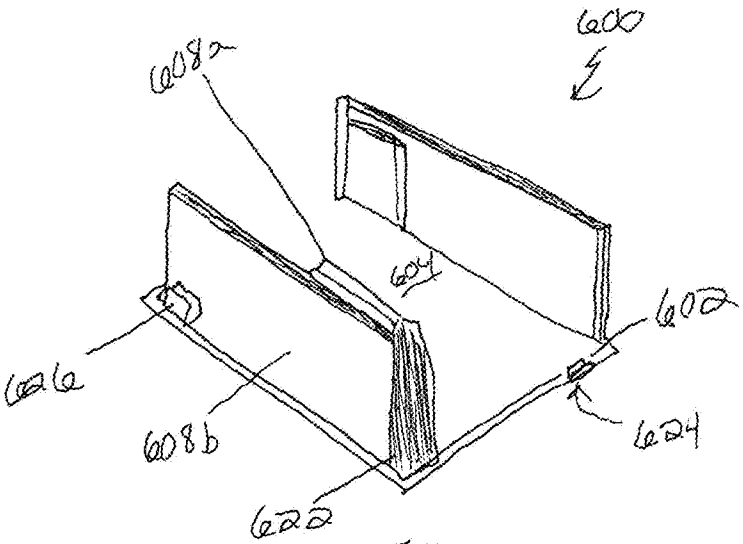
FIG. 7 is another perspective view of the guard device of FIG. 6, with panels in a transition between an upright configuration and a tabletop configuration, according to one or more embodiments.
Figure 6:
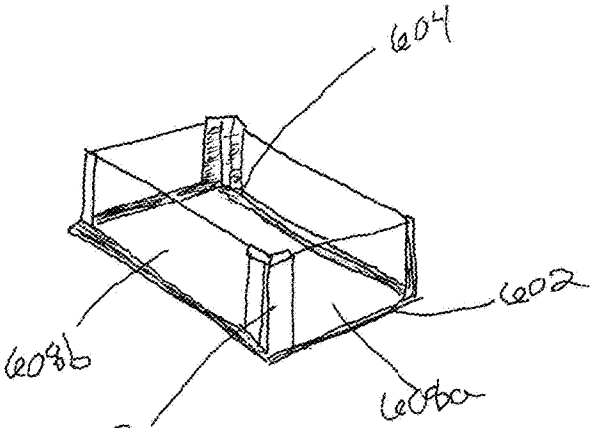
FIG. 6 is a perspective view of another guard device of the present disclosure, with panels in an upright configuration, according to one or more embodiments.
Figure 8:
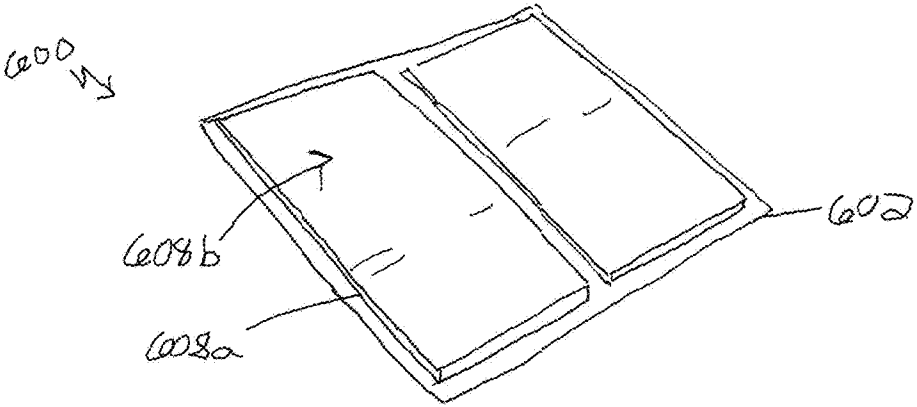
FIG. 8 is another perspective view of the guard device of FIG. 6, with panels in a tabletop configuration, according to one or more embodiments.

FIGS. 6-8 illustrate another embodiment of a guard device 600 of the present disclosure. The guard device 600 may generally have a base portion 602 defining a fire area 604. The base portion 602 and panels 608 may have features similar to some of those described above with respect to FIGS. 1 and 2. Like the panels described above, the or more panels 608 of FIGS. 6-8 may be configured to be arranged in an upright configuration and a tabletop configuration. However, the panels 608 shown in FIGS. 6-8 may be supported using different mechanisms in the upright configuration, tabletop configuration, and/or in the transition between configurations. As depicted in FIGS. 6-8, in some embodiments, hinges may be used to convert the panels 608 between the upright configuration and the tabletop configuration. For example, the panels 608 may be coupled to the base portion 602 and/or to one another via one or more hinges.

As shown in FIG. 6, in some embodiments, a first panel 608*a* may couple to a second 608*b* panel via a hinge 622, such as a piano hinge or other suitable type of hinge. The hinge 622 may generally allow the first panel 608*a* to be folded against the second panel 608*b*, as shown in FIG. 7. The base portion 602 may have a catch or latch 624 configured to receive the first panel 608*a* when it is unfolded, or generally hinged away from, the second panel 608*b*. The catch or latch 624 may position the first panel 608*a* with respect to the base portion 602 in the upright configuration.

Additionally, the second panel 608*b* may be coupled to the base portion 602 via a hinge 626, such as a pin hinge or other suitable type of hinge. The pin hinge 626 may be configured such that the second panel 608*b* may pivot between the upright configuration and the tabletop configuration. In this way, the pin hinge 626 may allow the second panel 608*b* to pivot upright over the base portion 602, as shown in FIGS. 6 and 7, or downward into or over the fire area 604 defined by the base portion, as shown in FIG. 8. As the second panel 608*b* pivots upward or downward about the pin hinge 626 at the base portion 602, the first panel 608*a* may pivot with the second panel. In some embodiments, the base portion 602 may have one or more inner ledges, similar to those described above, to support the first and second panels in the tabletop configuration.

In still other embodiments, other mechanisms for coupling the panels to the base portion, to one another, for supporting the panels in either configuration, and/or for transitioning the panels between configurations may be contemplated as well. For example, as shown in Appendix A, the panels may be coupled to the base portion with one or more pin hinges in order to lock the panels in place in each of the upright and tabletop configurations. As additionally shown in Appendix A, in some embodiments, the panels may couple to the base portion using a slotted hinge configuration. As additionally shown in Appendix A, one or more clips, such as one or more hinged clips coupled to the base portion and/or panels may be used to couple the panels to the base in the upright and/or tabletop configuration.

Figure 9:
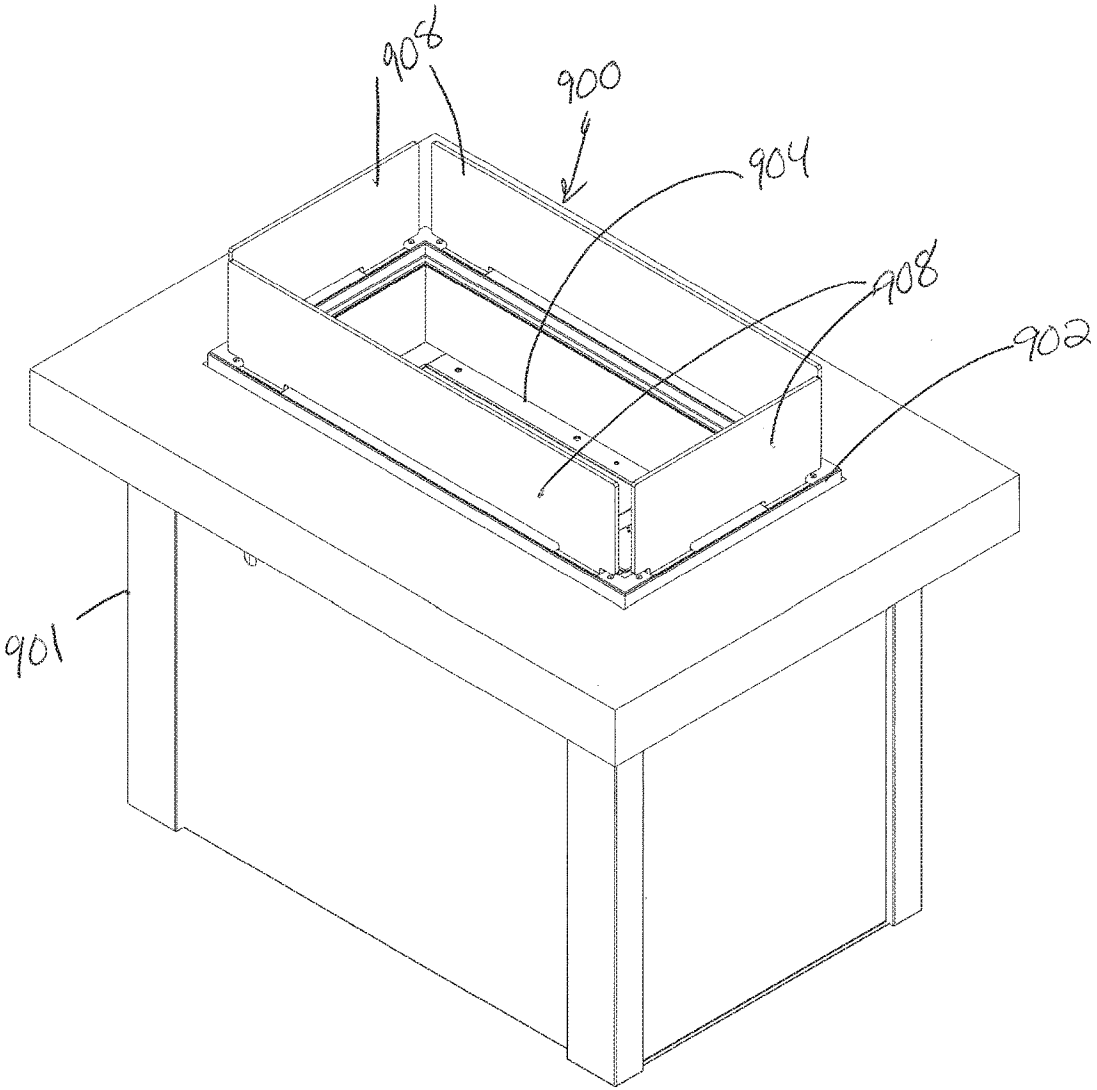
FIG. 9 is a perspective view of a guard device of the present disclosure arranged on a fire heating appliance, with panels in an upright configuration, according to one or more embodiments.
Figure 10:
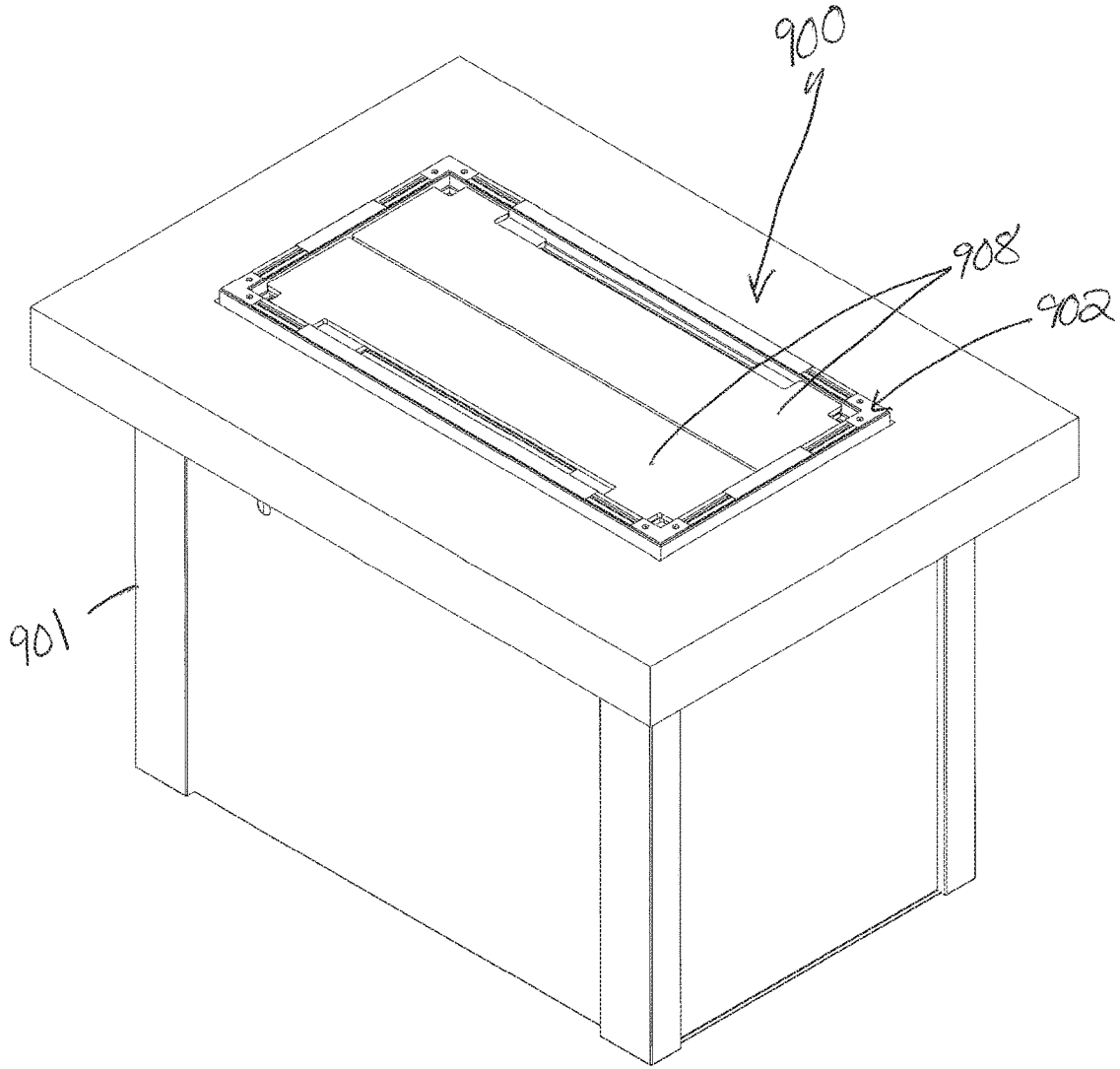
FIG. 10 is another perspective view of the guard device and fire heating appliance of FIG. 9, with panels in a tabletop configuration, according to one or more embodiments.

Turning now to FIGS. 9 and 10, another embodiment of a glass guard 900 is shown arranged on a fire heating appliance 901. The glass guard 900 may have a base portion 902 and a plurality of panels 908 positioned on the heating appliance with the base portion surrounding a fire area 904 in which a fire producing element may be arranged. The glass guard 900 may have a plurality of panels 908, such as glass, plastic, Plexiglass, or other material panels, configured to be arranged in an upright configuration, as shown in FIG. 9, and additionally be configured to be arranged in a tabletop configuration, as shown in FIG. 10. The panels 908 may be similar to panels described above. For example, as shown in FIG. 11 for example, each panel 908 may have a generally rectangular or square shape and may have one or more flanges 910 for arranging in a slot or groove of the base portion 902.

Figure 11:
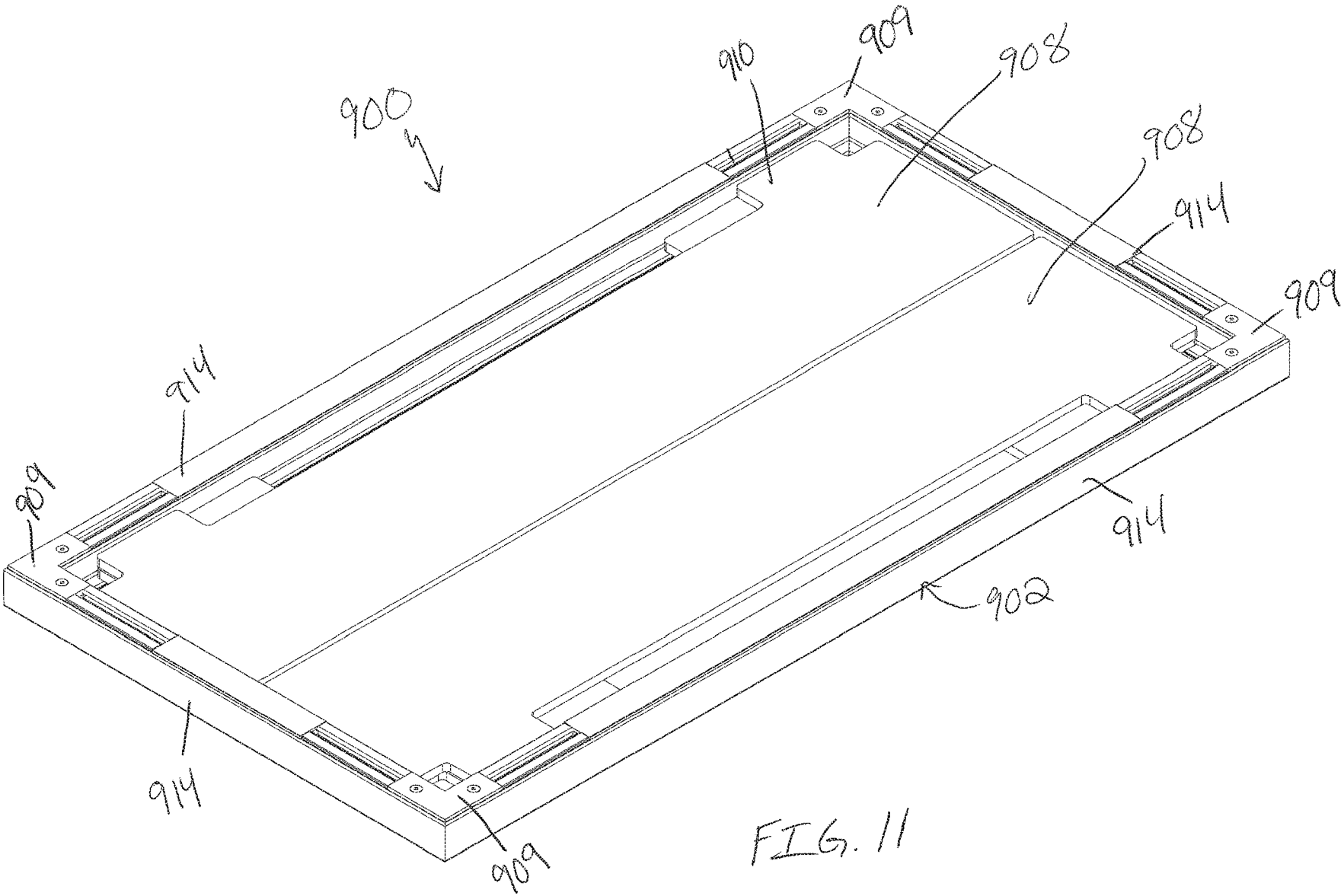
FIG. 11 is a perspective view of the guard device of FIG. 9 with panels in a tabletop configuration, according to one or more embodiments.
Figure 12:
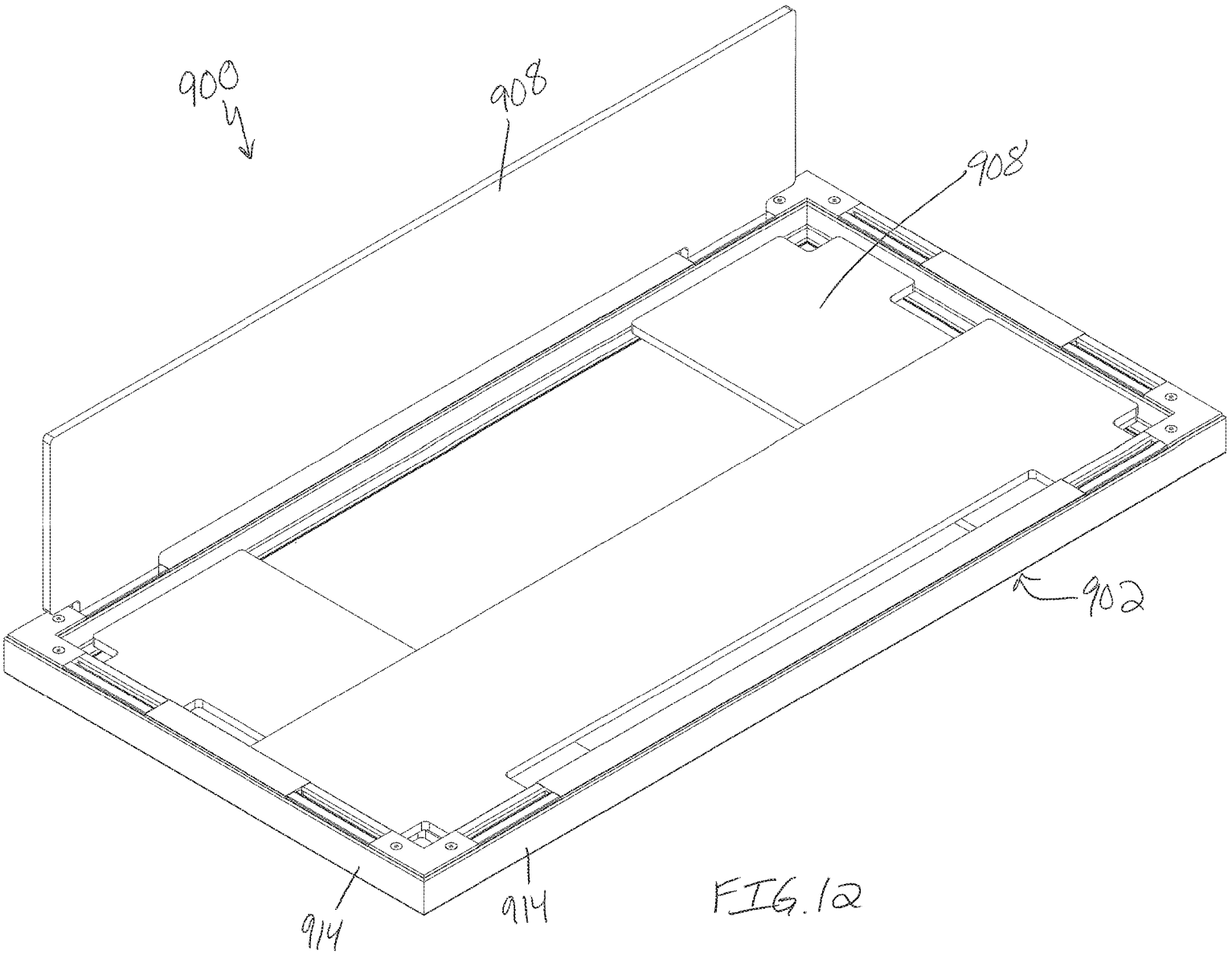
FIG. 12 is a perspective view of the guard device of FIG. 9, with one panel in an upright configuration and three panels in a tabletop configuration, according to one or more embodiments.
Figure 13:
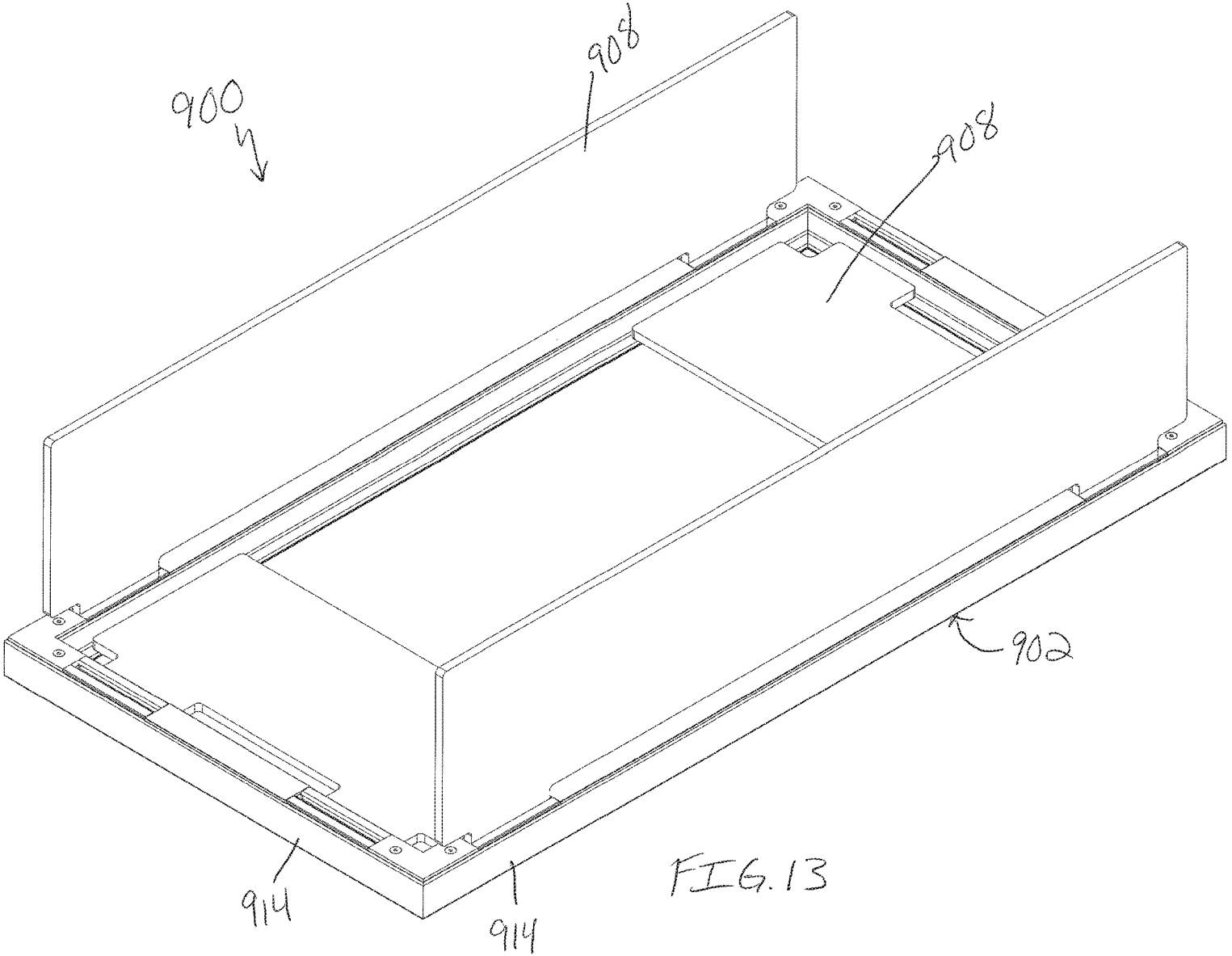
FIG. 13 is a perspective view of the guard device of FIG. 9, with two panels in an upright configuration and two panels in a tabletop configuration, according to one or more embodiments.
Figure 14:
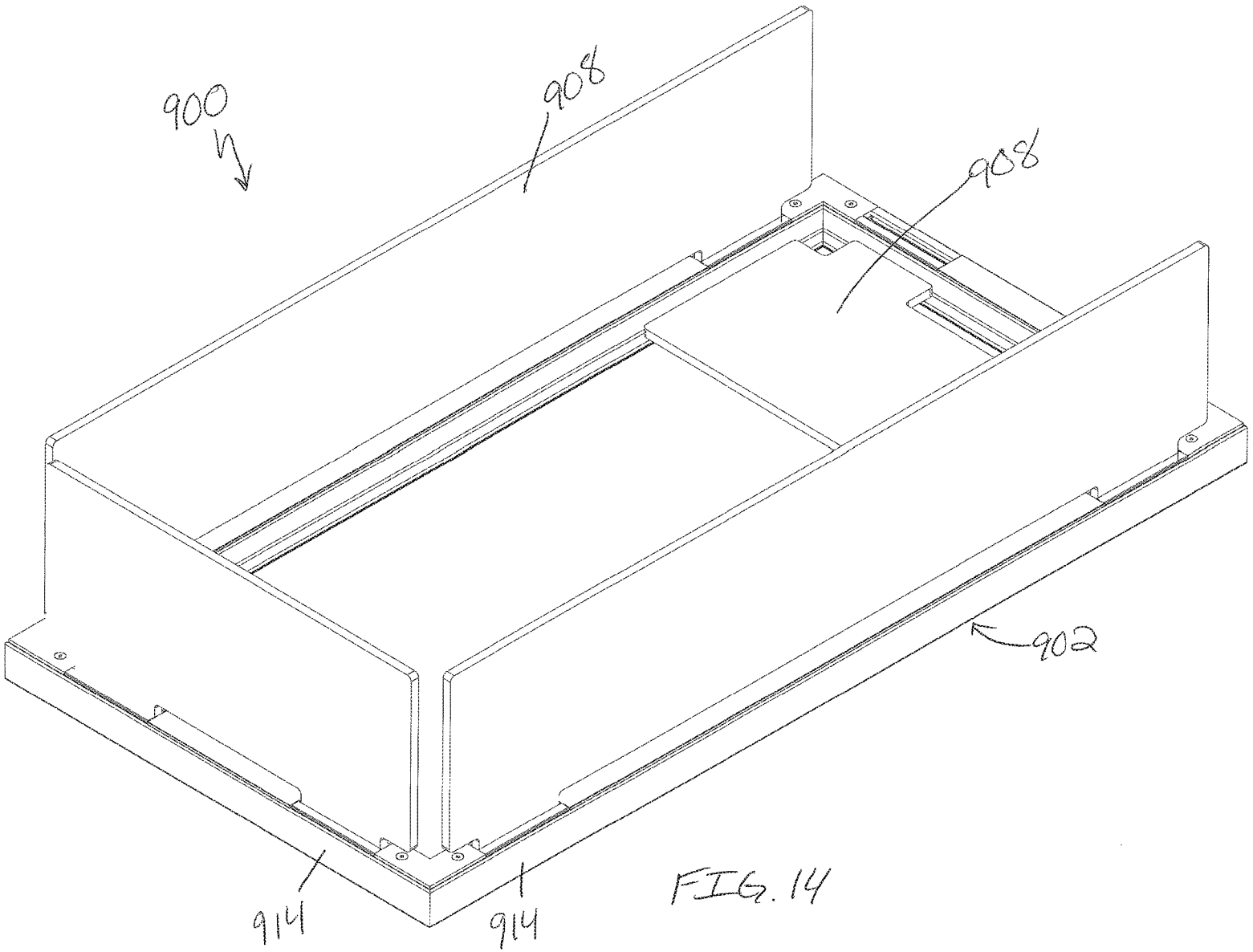
FIG. 14 is a perspective view of the guard device of FIG. 9, with three panels in an upright configuration and one panel in a tabletop configuration, according to one or more embodiments.
Figure 15:
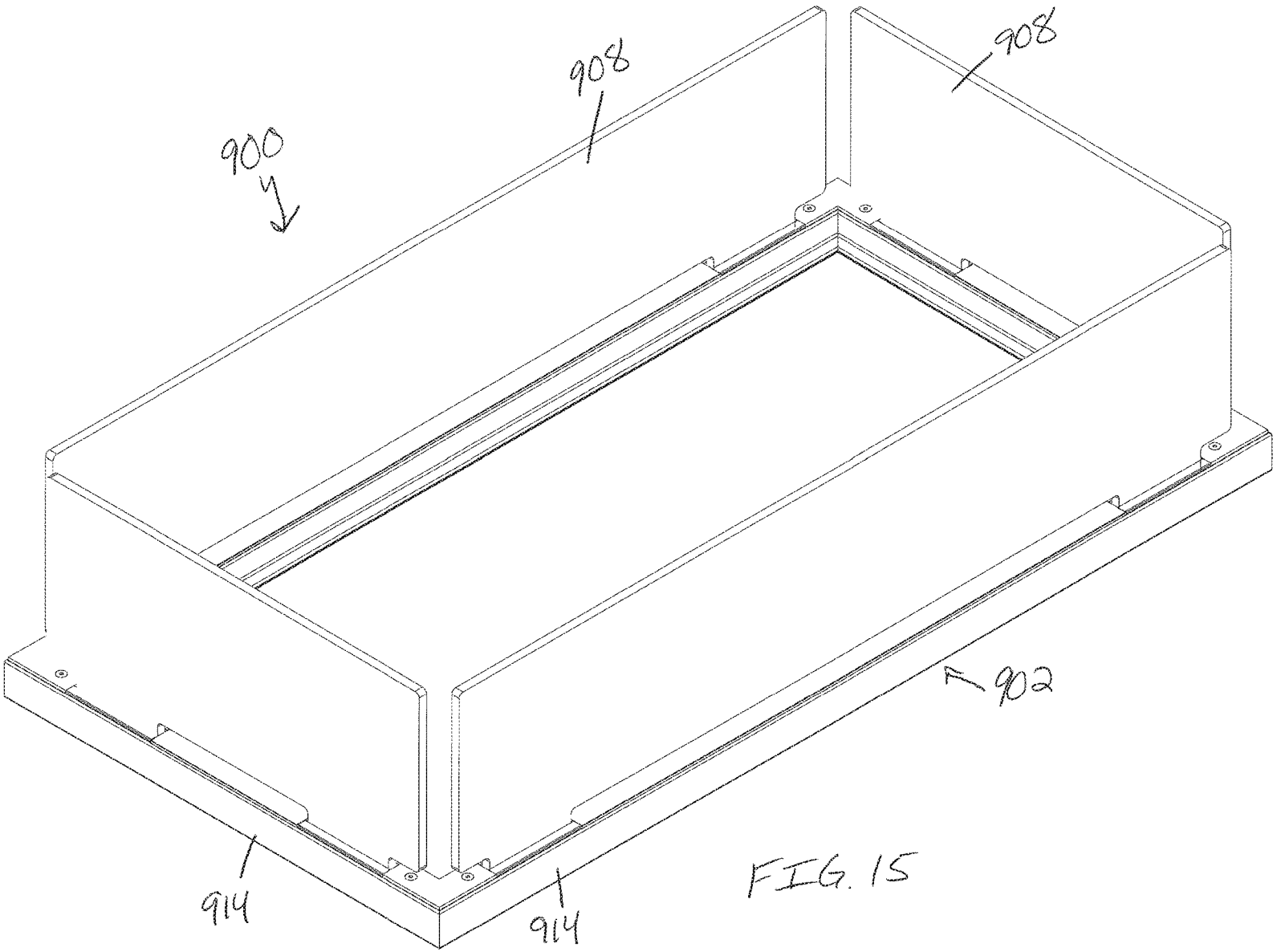
FIG. 15 is a perspective view of the guard device of FIG. 9, with panels in an upright configuration, according to one or more embodiments.

As further shown in FIG. 11, the base portion 902 may have a plurality of members 914 arranged in a suitable shape to surround the fire area. For example, the base portion 902 may have four members 914 forming a rectangular shape, with two longer members and two shorter members. A bracket 909 may be arranged at each corner to couple members 914 together. Each member 914 may be configured to receive flanges 910 of a panel 908 so as to arrange the panel in an upright configuration. Additionally, each member 914 may be configured to support a panel, or a portion of at least one panel 908, in a tabletop configuration. FIG. 10 illustrates the panels 908 arranged in a tabletop configuration. FIGS. 11-15 illustrate a progression of the glass guard 900 from a tabletop configuration to an upright configuration.

Figure 16:
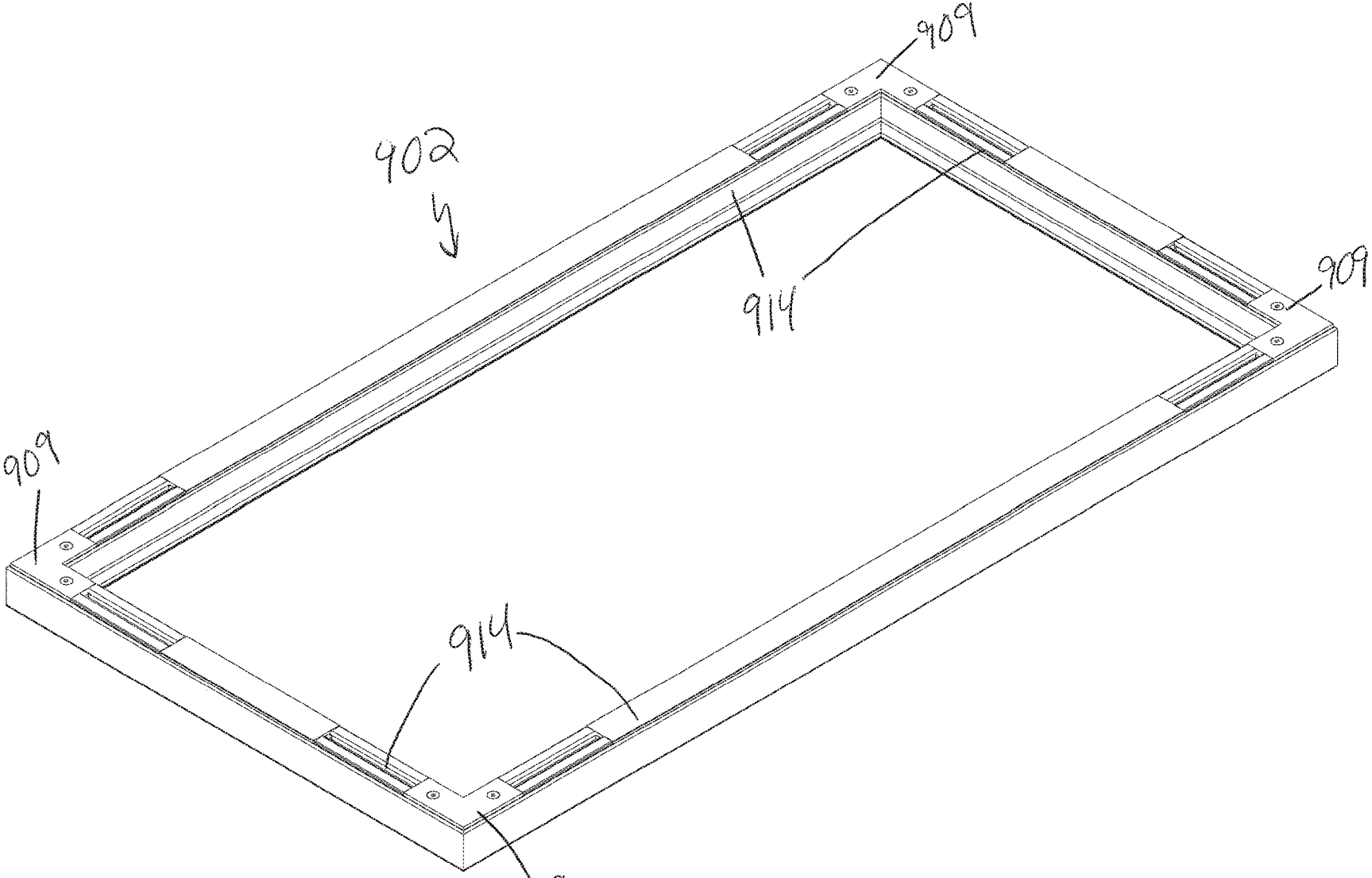
FIG. 16 is a perspective view of a base portion of a guard device of the present disclosure, according to one or more embodiments.
Figure 17:
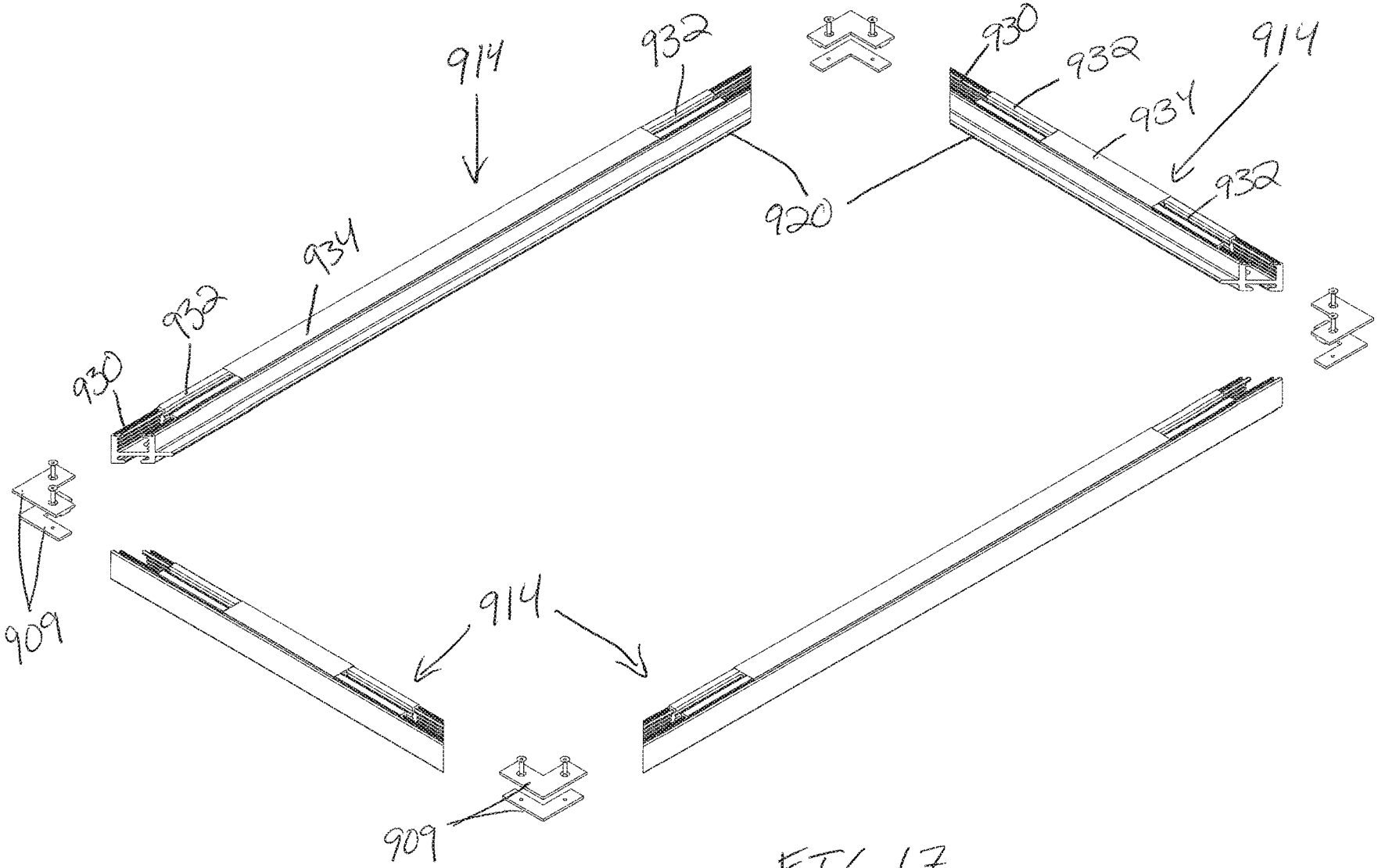
FIG. 17 is an exploded view of the base portion of the guard device of FIG. 16, according to one or more embodiments.
Figure 18:
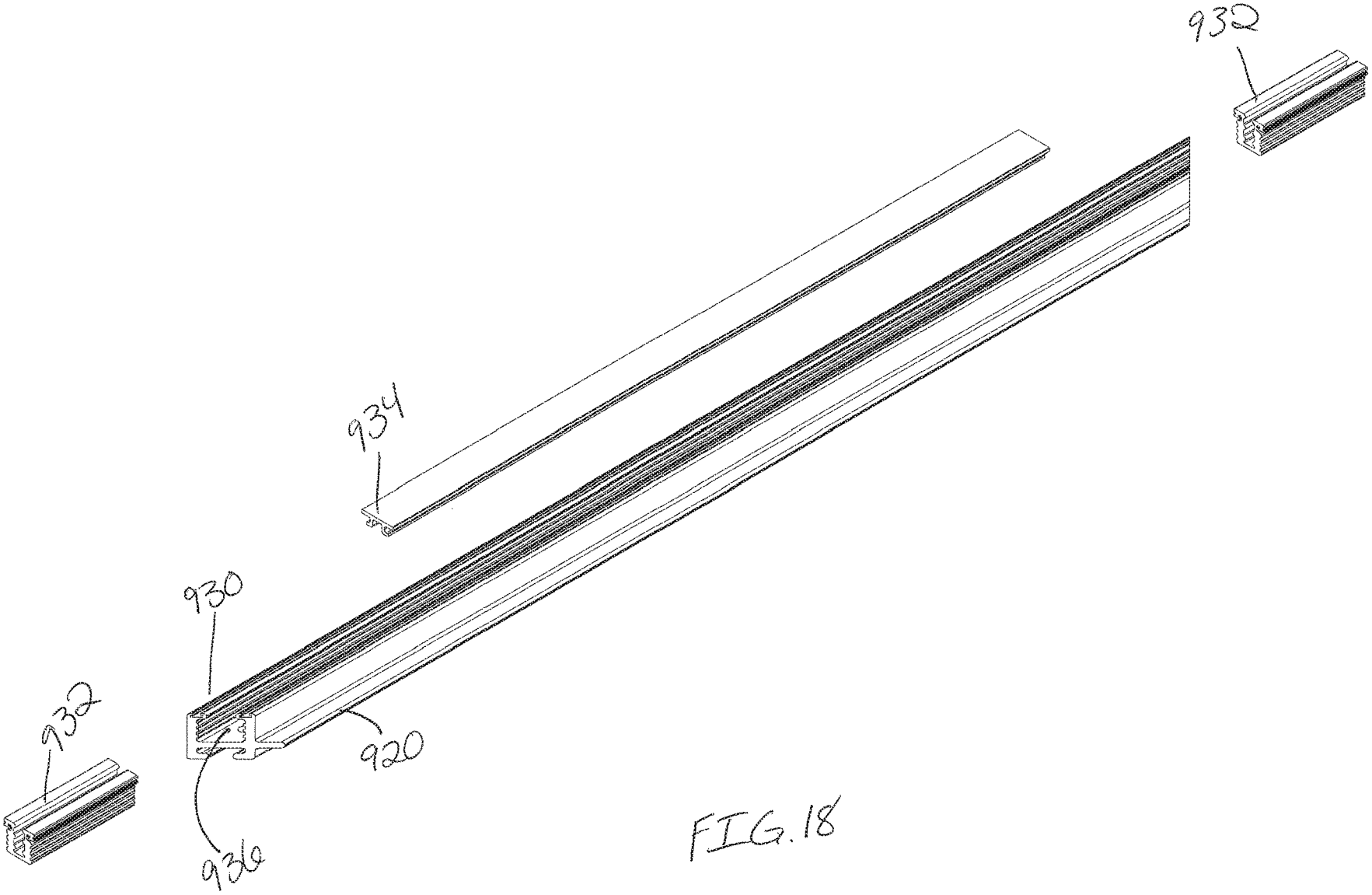
FIG. 18 is an exploded view of a base portion member of a guard device of the present disclosure, according to one or more embodiments.

FIGS. 16 and 17 show an isolated and exploded view, respectively, of the base portion 902. As shown in FIG. 18, each member 914 of the base portion 902 may have a channel portion 930, one or more panel receiving portions 932, and one or more channel covers 934. The channel portion 930 may be configured to receive the panel receiving portion(s) 932 and channel cover(s) 934 so as to form a complete member 914. For example and as shown in FIG. 18, the channel portion 930 may define a channel 936 having a rectangular, square, or other suitable cross-sectional shape. The channel 936 may have three sides, and may be open or substantially open on a fourth side, which may be an upper or top side from which upright panels 908 are configured to extend. One or more walls of the channel 936 may have a series of ridges 935 configured to engage with the panel receiving portions 932 and/or channel cover 934. This may further be seen in the cross-sectional view of FIG. 19. The channel portion 930 may additionally have a ledge or groove 938 extending from one or more walls of the channel 936 to engage with the panel receiving portions 932 and/or channel cover 934.

The channel portion 930 may additionally have a pair of lower ledges 940 extending below the channel 936 and defining a lower groove. The lower groove may be configured to help couple the base portion 902 to a fire heating appliance. Further, the channel portion 930 may have a shelf 920 extending outward from the channel portion and configured to receive one or more panels 908 in a tabletop configuration. As shown in FIG. 18, the shelf 920 may extend along an outer wall of the channel portion 930, and may extend across a full length of the channel portion. In some embodiments, the channel portion 930 may have more than one shelf 920, with differing shelves arranged at differing heights to accommodate upper and lower panels 908 in the tabletop configuration.

The channel portion 930 may be constructed of aluminum in some embodiments. In other embodiments, the channel portion 930 may be constructed of other materials, including additional or alternative metals and/or plastics. The channel portion 930 may be constructed using extrusion in some embodiments.

Figure 19:
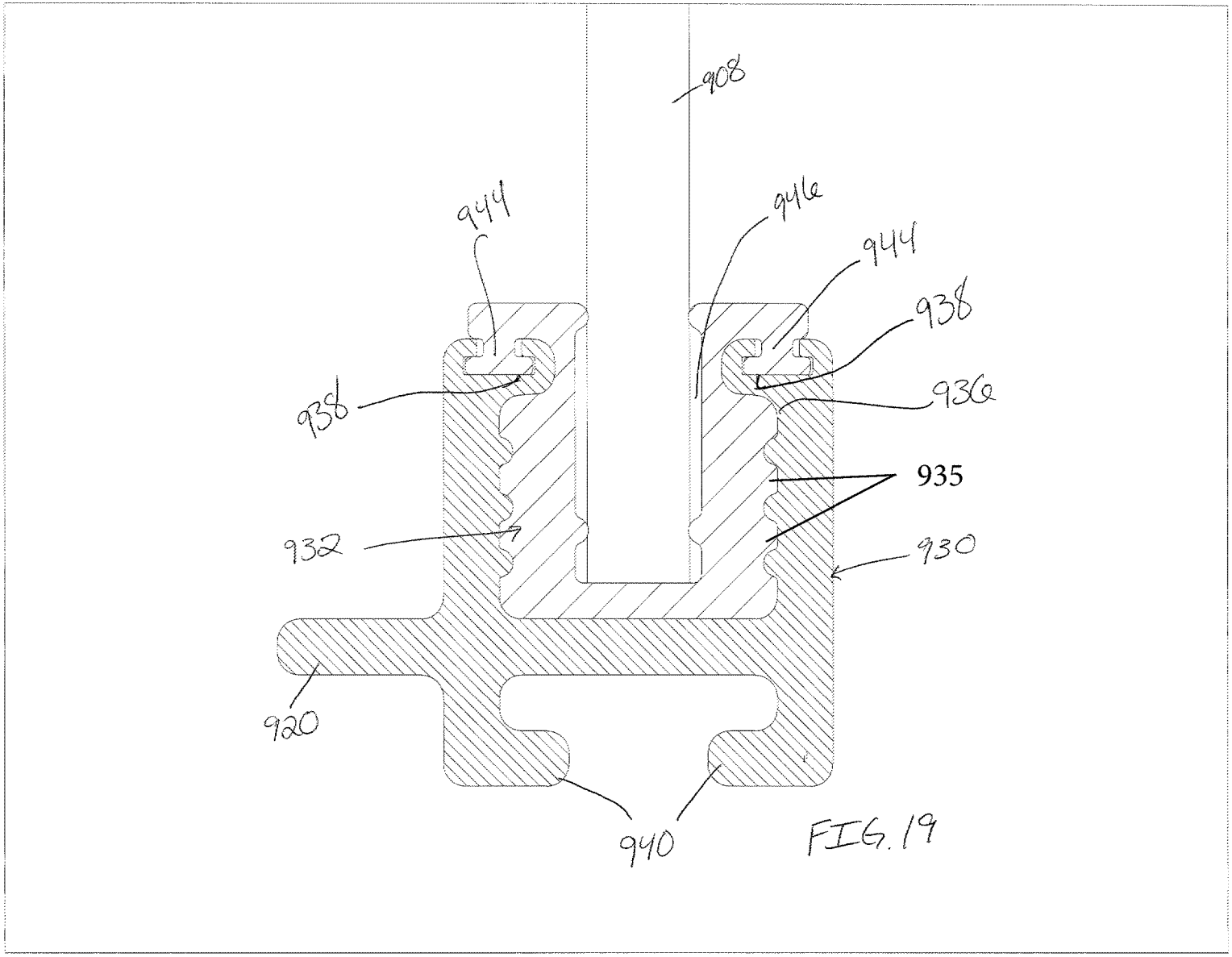
FIG. 19 is a cross-sectional view of a panel and base portion member of a guard device of the present disclosure, according to one or more embodiments.

The panel receiving portions 932 and channel covers 934 may be configured to engage with the channel portion 930. For example, as shown in FIG. 19, each panel receiving portion 932 may have a generally rectangular or square shape configured to fit snuggly within the rectangular or square channel 936. Where the channel 936 has a different shape, the panel receiving portion 932 may have a corresponding outer shape to fit within the channel. Moreover, the panel receiving portion 932 may have a series of outer notches configured to engage with the inner channel ridges of the channel 936. The panel receiving portion 932 may further have a pair of ledges 944 configured to engage with the grooves 938 of the channel portion 930. The panel receiving portion 932 may further have a central slot 946 configured to receive a panel 908 in an upright configuration. In some embodiments, the slot 946 may have inner ridges configured to generally grip a panel 908 inserted in the slot. The panel receiving portion 932 may be constructed of silicon, rubber, or another generally flexible material. The panel receiving portion 932 may have a length configured to receive a tab or flange of a panel 908.

With reference to FIG. 18, each channel cover 934 may be configured to provide a cover or cap over at least a portion of the channel 936. The channel cover 934 may generally be configured to cover a portion of the channel 936 that does not have a panel receiving portion 932 arranged therein. For example, as shown in FIG. 17, a channel cover 934 may be configured to extend along and over a length of channel 936 between two panel receiving portions 932. The channel cover 934 may have a flat cap portion configured to extend across the channel 936, and a pair of tabs configured to extend into the channel 936, engage the grooves 938, or otherwise engage with the channel portion 930. The channel cover 934 may be constructed of one or more plastics, metals, and/or other suitable materials. The channel cover 934 may be extruded in some embodiments.

With continued reference to FIGS. 18 and 19, it is to be appreciated that each of the four channel portions 930 may have a same cross-sectional shape. Moreover, each of the panel receiving portions 932 may have a same cross-sectional shape, and each of the channel covers 934 may have a same cross-sectional shape. In this way, construction of the base portion 902 may be simplified due to an ability to cut or extrude channel portions 930, panel receiving portions 932, and channel covers 934 to any suitable length. This may lead to relatively cost-effective and efficient manufacturing of the base portion 902. Moreover, the ability to cut or extrude channel portions 930, panel receiving portions 932, and channel covers 934 in any suitable length may allow for variability in the size and shape of base portions. By cutting or extruding the components to the desired lengths, a manufacturer may construct a base portion 902 having a desired size with a desired shape and number of sides.

Figure 5:
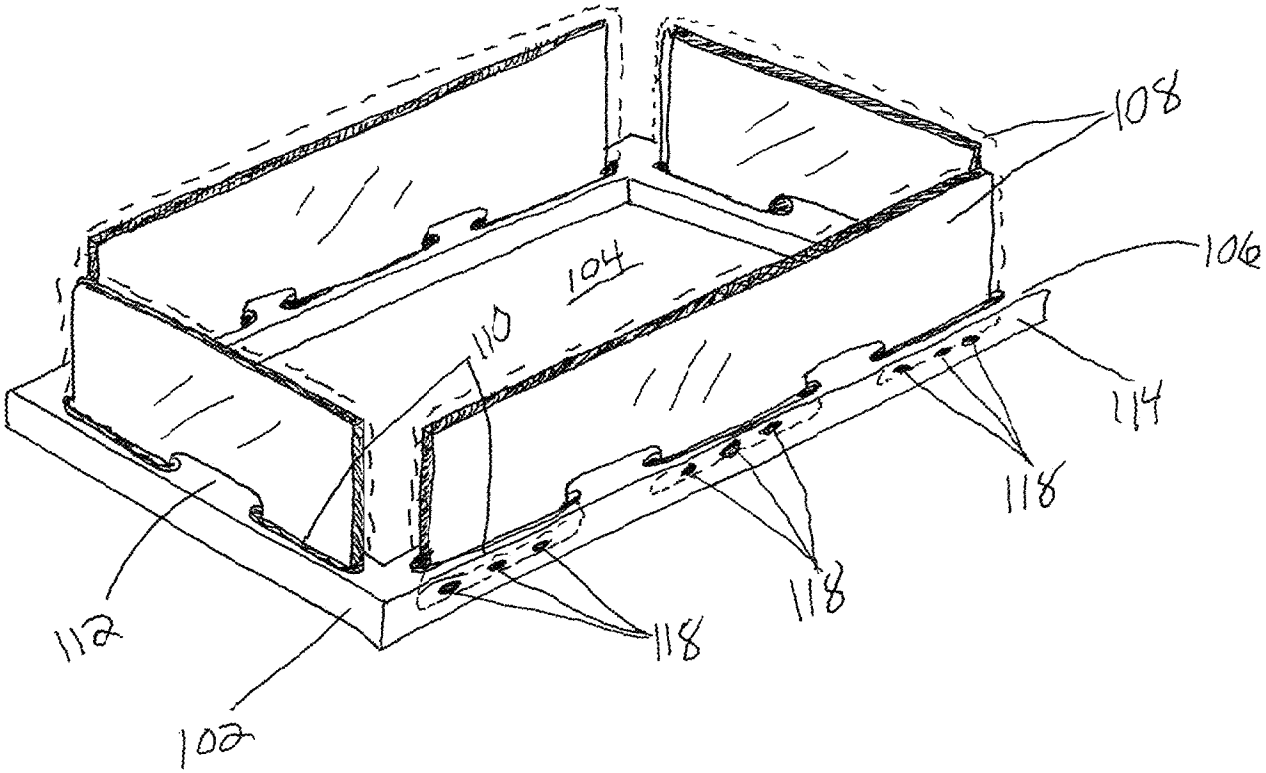
FIG. 5 is a perspective view of another guard device of the present disclosure, according to one or more embodiments.

In yet another embodiment of a glass guard of the present disclosure, the base portion may be produced as substantially a single component. For example, thermoforming or another suitable process may be employed to produce a rectangular or square base portion having four sides, four corners, grooves for receiving glass panels in an upright configuration, and ledges for receiving glass panels in a tabletop configuration. FIGS. 3-5 show some embodiments of a base portion that may be produced as substantially a single component. Of course a single-element base portion may be produced to have other shapes and configurations as well. In some embodiments, the base portion may be produced with openings or gaps to allow air to flow through the sides of the base portion (such as to allow airflow to a flame) and/or to allow for a user to grasp and position glass panels on the base portion). Such openings or gaps may be molded or thermoformed into the base portion. Further, in embodiments where the base portion includes such openings or gaps to allow air flow and/or hand holds, the moveable panels may be substantially rectangular or square, without the need for the gaps or flanges described above.

Although the present invention has been described with reference to preferred embodiments, persons skilled in the art will recognize that changes may be made in form and detail without departing from the spirit and scope of the invention.

What is claimed is:

1. A convertible guard device for a fire heating appliance, the guard device comprising:

a plurality of panels, the panels configured to be arranged in a guard configuration and a tabletop configuration; and a base portion defining a fire area, and comprising:

an upper surface configured to receive the panels arranged in the guard configuration; and an inner surface having a ledge extending therefrom, the ledge configured to receive a perimeter edge of the panels when the panels are arranged in the tabletop configuration, wherein, in the guard configuration, the plurality of panels surround the fire area on all sides thereof.

2. The guard device of claim 1, wherein each panel comprises a flange extending therefrom, and wherein the upper surface of the base portion comprises a plurality of grooves, each groove configured to receive a flange when the panels are arranged in the guard configuration.

3. The guard device of claim 2, wherein one or more of the plurality of grooves comprise an LED light arranged therein.

4. The guard device of claim 1, wherein at least one panel comprises a gap therethrough.

5. The guard device of claim 1, wherein the base portion comprises a plurality of members, each member defining a side of the fire area.

6. The guard device of claim 1, wherein the plurality of panels comprises a pair of panels coupled together via a hinge.

7. The guard device of claim 6, wherein the hinge is a piano hinge.

8. The guard device of claim 1, wherein at least one of the plurality of panels is coupled to the base portion via a hinge.

9. The guard device of claim 1, wherein the base comprises a plurality of members comprising a channel portion.

10. The guard device of claim 9, wherein the plurality of members further comprise a panel receiving portion configured for insertion in the channel portion.

11. The guard device of claim 10, wherein the plurality of members further comprise a channel cover.

12. The guard device of claim 11, wherein the channel portion comprises a plurality of ridges configured to engage with the panel receiving portion, the channel cover, or both.

13. The guard device of claim 11, wherein the channel cover is configured to provide a cover over a portion of the channel portion.

14. The guard device of claim 13, wherein the channel cover is configured to provide a cover of a portion of the channel portion that does not contain a panel receiving portion.

15. The guard device of claim 10, wherein the panel receiving portion has a length configured to receive a tab or flange of the plurality of panels.

16. The guard device of claim 15, wherein the panel receiving portion comprises a flexible material.

17. The guard device of claim 10, wherein the plurality of members have a same cross-sectional shape.

18. The guard device of claim 17, wherein the panel receiving portion of each of the plurality of members have a same cross-sectional shape.

19. The guard device of claim 9, wherein the plurality of members each comprise a shelf extending outward from the channel portion forming the ledge.

20. A convertible guard device for a fire heating appliance, the guard device comprising:

a plurality of panels, the panels configured to be arranged in a guard configuration and a tabletop configuration, each panel having a tab extending from a lengthwise side thereof; and a base portion defining a fire area, and comprising:

a plurality of channel members; and a plurality of panel receiving portions comprising a flexible material configured for arrangement in one of the plurality of channel members and for releasably receiving and gripping the tab of a respective panel of the plurality of panels when arranged in the guard configuration, wherein, the plurality of channel members all have a same cross-sectional shape and the plurality of panel receiving portions all have a same cross-sectional shape.

21. The guard device of claim 20, wherein the base portion further comprises a channel cover.

22. The guard device of claim 21, wherein the plurality of channel members comprise a plurality of ridges configured to engage with the plurality of panel receiving portions, the channel cover, or both.

23. The guard device of claim 21, wherein the channel cover is configured to provide a cover over a portion of a channel of the plurality of channel members.

24. The guard device of claim 23, wherein the channel cover is configured to provide a cover of a portion of the channel that does not contain a panel receiving portion of the plurality of panel receiving portions.

25. The guard device of claim 20, wherein the plurality of channel members each comprise a shelf extending outward therefrom.

26. The guard device of claim 20, wherein the plurality of panel receiving portions each have a length configured to receive the tab of a respective panel of the plurality of panels.

* * * * *